US007909012B2

(12) United States Patent
Pattakos et al.

(10) Patent No.: US 7,909,012 B2
(45) Date of Patent: Mar. 22, 2011

(54) PULLING ROD ENGINE

(76) Inventors: Manousos Pattakos, Nikea Piraeus (GR); Efthimios Pattakos, Nikea Piraeus (GR); Paraskevi Pattakou, Nikea Piraeus (GR); Emmanouel Pattakos, Nikea Piraeus (GR)

( * ) Notice: Subject to any disclaimer, the term of this patent is extended or adjusted under 35 U.S.C. 154(b) by 426 days.

(21) Appl. No.: 12/162,357

(22) PCT Filed: Jan. 28, 2007

(86) PCT No.: PCT/EP2007/050809

§ 371 (c)(1),
(2), (4) Date: Jul. 28, 2008

(87) PCT Pub. No.: WO2007/085649

PCT Pub. Date: Aug. 2, 2007

(65) Prior Publication Data

US 2009/0165744 A1 Jul. 2, 2009

(30) Foreign Application Priority Data

Jan. 30, 2006 (GR) ..... 060100048
Mar. 1, 2006 (GR) ..... 060100131

(51) Int. Cl.
*F02B 75/32* (2006.01)

(52) U.S. Cl. ..... 123/197.4; 74/579 E

(58) Field of Classification Search .... 123/197.1–197.4; 74/579 R, 579 E

See application file for complete search history.

(56) References Cited

U.S. PATENT DOCUMENTS 5,156,121 A * 10/1992 Routery ..... 123/197.3

* cited by examiner

*Primary Examiner* — Noah Kamen

(57) ABSTRACT

The piston is connected to the crankshaft via a connecting rod, while the crankshaft is disposed between the wrist pin and the combustion chamber. This way the combustion is shifted to the slow dead center, enabling the diesel to perform at higher revs, improving the spark engine efficiency and making HCCI combustion easier. Though the crankshaft is of one piece, more connecting rods can be used for a piston. As opposed piston, the PRE engine further combines top specific power, top thermal efficiency, built in scavenging pumps, and compactness.

8 Claims, 18 Drawing Sheets

| Ratio of crank angle in case of Pulling Rod Engine (PRE) to crank angle in case of Conventional ( Pushing Rod ) Engine | | | | | | | | | | | Rod Length (% of stroke) | |
|---|---|---|---|---|---|---|---|---|---|---|---|---|
| | Piston travel from TDC ( percentage of piston stroke ) | | | | | | | | | | | |
| | 5 | 10 | 15 | 20 | 25 | 30 | 35 | 40 | 45 | 50 | PRE | Conv |
| | 1,60 | 1,56 | 1,52 | 1,48 | 1,45 | 1,42 | 1,39 | 1,36 | 1,34 | 1,31 | 100 | 140 |
| | 1,57 | 1,53 | 1,49 | 1,46 | 1,42 | 1,39 | 1,37 | 1,34 | 1,31 | 1,29 | 100 | 160 |
| | 1,55 | 1,51 | 1,47 | 1,44 | 1,41 | 1,38 | 1,35 | 1,32 | 1,30 | 1,27 | 100 | 180 |
| | 1,53 | 1,49 | 1,46 | 1,42 | 1,39 | 1,36 | 1,33 | 1,31 | 1,28 | 1,26 | 100 | 200 |
| | 1,49 | 1,46 | 1,44 | 1,41 | 1,39 | 1,37 | 1,34 | 1,32 | 1,30 | 1,28 | 120 | 140 |
| | 1,47 | 1,44 | 1,41 | 1,39 | 1,36 | 1,34 | 1,32 | 1,30 | 1,28 | 1,26 | 120 | 160 |
| | 1,45 | 1,42 | 1,39 | 1,37 | 1,35 | 1,32 | 1,30 | 1,28 | 1,26 | 1,24 | 120 | 180 |
| | 1,43 | 1,41 | 1,38 | 1,36 | 1,33 | 1,31 | 1,29 | 1,27 | 1,25 | 1,23 | 120 | 200 |
| | 1,43 | 1,41 | 1,39 | 1,37 | 1,35 | 1,33 | 1,31 | 1,29 | 1,28 | 1,26 | 140 | 140 |
| | 1,41 | 1,38 | 1,36 | 1,34 | 1,33 | 1,31 | 1,29 | 1,27 | 1,25 | 1,24 | 140 | 160 |
| | 1,39 | 1,37 | 1,35 | 1,33 | 1,31 | 1,29 | 1,27 | 1,26 | 1,24 | 1,22 | 140 | 180 |
| | 1,37 | 1,35 | 1,33 | 1,31 | 1,29 | 1,28 | 1,26 | 1,24 | 1,23 | 1,21 | 140 | 200 |
| | 1,39 | 1,37 | 1,35 | 1,34 | 1,32 | 1,30 | 1,29 | 1,27 | 1,26 | 1,24 | 160 | 140 |
| | 1,36 | 1,35 | 1,33 | 1,31 | 1,30 | 1,28 | 1,27 | 1,25 | 1,24 | 1,22 | 160 | 160 |
| | 1,35 | 1,33 | 1,31 | 1,30 | 1,28 | 1,27 | 1,25 | 1,24 | 1,22 | 1,21 | 160 | 180 |
| | 1,33 | 1,31 | 1,30 | 1,28 | 1,27 | 1,25 | 1,24 | 1,22 | 1,21 | 1,20 | 160 | 200 |
| | 1,36 | 1,34 | 1,33 | 1,31 | 1,30 | 1,28 | 1,27 | 1,26 | 1,24 | 1,23 | 180 | 140 |
| | 1,33 | 1,32 | 1,30 | 1,29 | 1,28 | 1,26 | 1,25 | 1,24 | 1,22 | 1,21 | 180 | 160 |
| | 1,32 | 1,30 | 1,29 | 1,27 | 1,26 | 1,25 | 1,23 | 1,22 | 1,21 | 1,19 | 180 | 180 |
| | 1,30 | 1,29 | 1,27 | 1,26 | 1,25 | 1,23 | 1,22 | 1,21 | 1,20 | 1,18 | 180 | 200 |

Fig 10

US 6,786,189

US 6,763,796

Pulling Rod Engine

Conventional Engine

US 6,062,187

PULLING ROD ENGINE

In U.S. Pat. No. 6,062,187, U.S. Pat. No. 6,763,796 and U.S. Pat. No. 6,786,189 patents, which are the closest prior art, the objective is to increase the thermal efficiency by increasing the degree of constant volume of a fuel-air mixture at the time of combustion.

Figure 21:
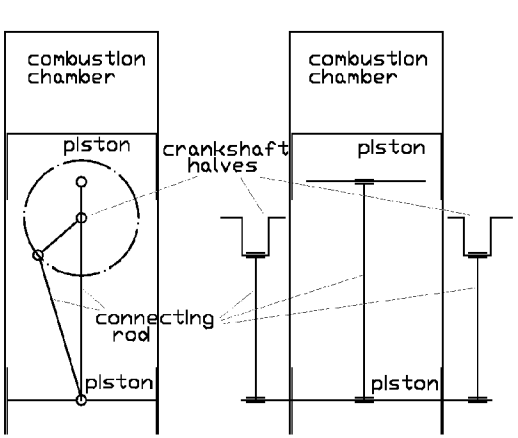
Figure 21:
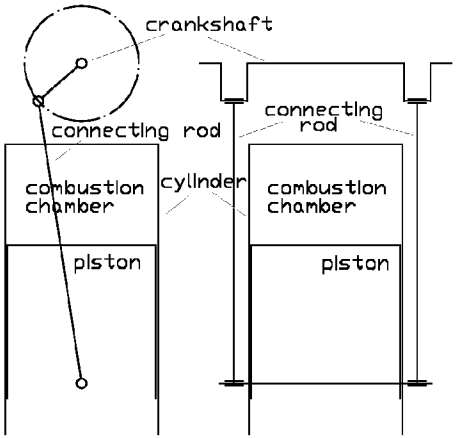
Figure 21:
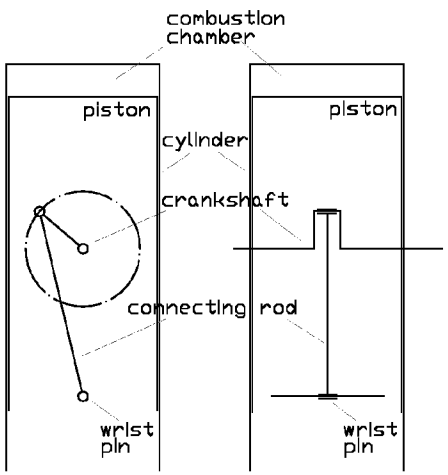
Figure 21:
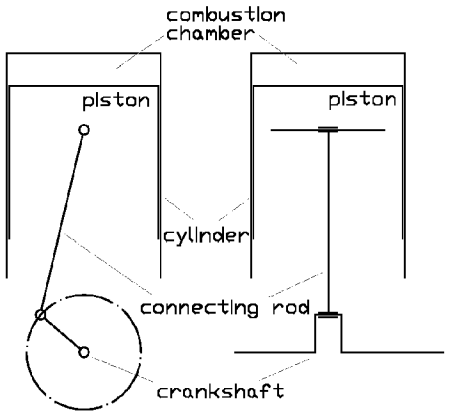
Figure 21:
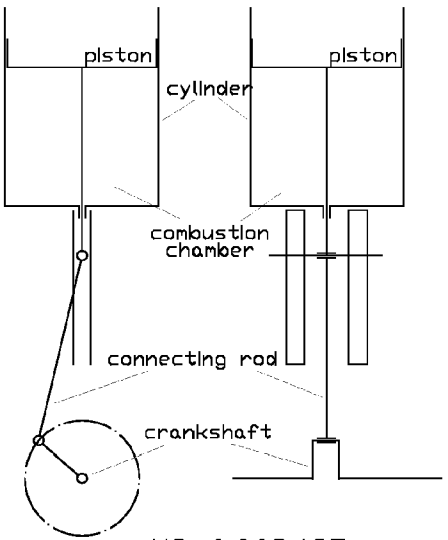

FIG. 21 contrasts the Conventional Engine to the closest prior art and to the present invention. In U.S. Pat. No. 6,062,187 the combustion chamber is disposed between the wrist pin and the piston. U.S. Pat. No. 6,763,796 patent claims a 'combustion chamber/cylinder head' disposed between the crankshaft and the piston. U.S. Pat. No. 6,786,189 patent shatters the unity of the crankshaft and compromises with synchronized 'crankshaft halves' disposed outside of the piston sliding path. In Pulling Rod Engine, or PRE, the crankshaft is disposed between the combustion chamber and the wrist pin.

Figure 6:
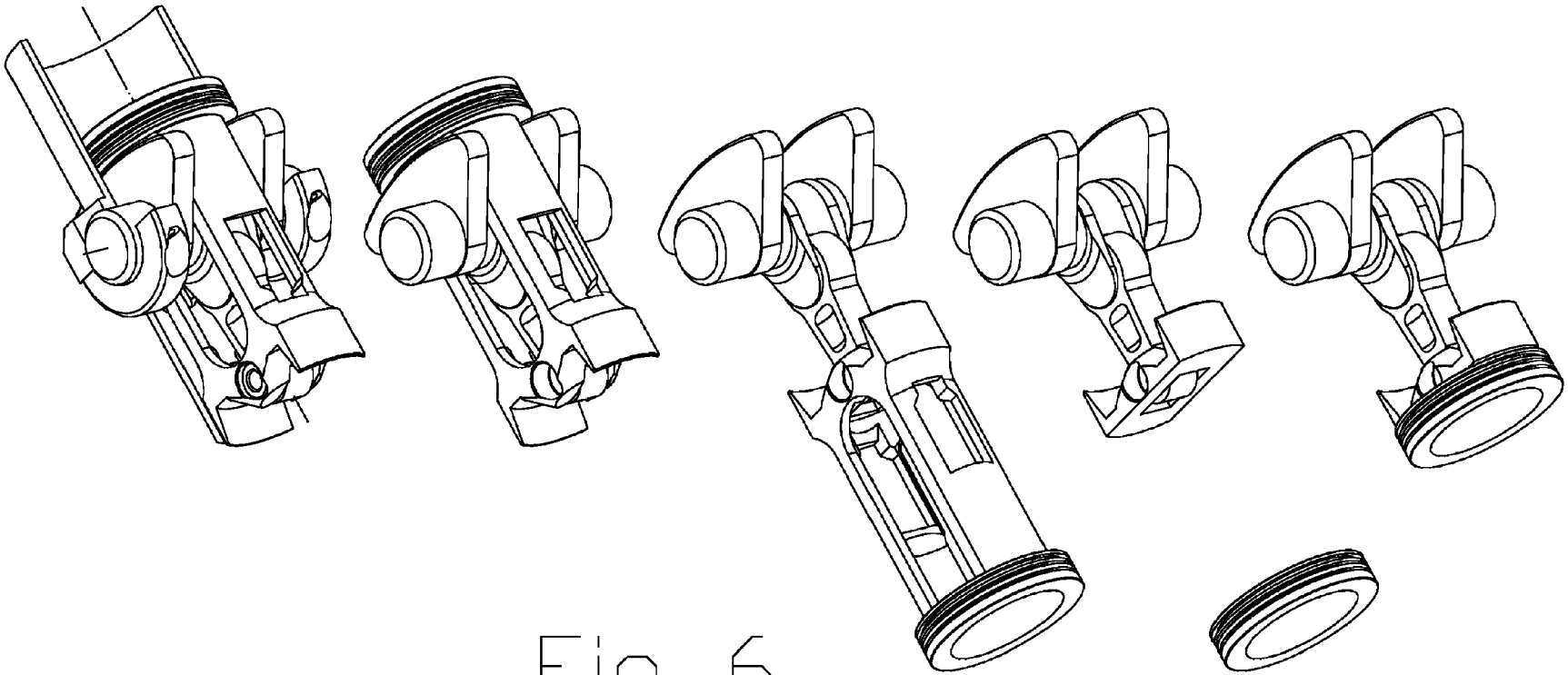

FIG. 6 shows, from left to right, the transition from the proposed arrangement to the conventional. At left the engine is assembled, then the cylinder—casing is removed, then the piston is rotated for 180 degrees about its wrist pin, and finally the piston shrinks in length to result the conventional mechanism, as shown at right most. This way the combustion shifts from the fast 'dead center' to the slow 'dead center'.

As in the conventional, at one end the connecting rod of the PRE is attached to a crank pin of a crankshaft, while at its other end it is attached, by a wrist pin, to a reciprocating member or piston. In contrast to conventional, the crankshaft of the PRE is disposed in between the combustion chamber and the wrist pin.

An object of the present invention is to improve the combustion by increasing the degree of constant volume of a fuel-air mixture at the time of combustion, i.e. by providing more time, at good conditions, to the mixture to get prepared and burned.

Another object is to combine the simplicity of the conventional engine with the efficiency of the mechanisms proposed in the closest prior art.

Another object is to propose some PRE arrangements suitable for specific applications.

Despite its simplicity, the proposed solution is non obvious. This becomes obvious looking at the solutions proposed in the closest prior art patents, where a pair of crankshaft halves, geared to each other, a pair of long length connecting rods, a long piston pin etc are necessary for every piston.

In FIGS. 1 to 12, (1) is the crankshaft, (2) is the cylinder, (3) is the piston, (4) is the piston crown, (5) is the connecting rod, (6) is the piston pin, (7) is the crankpin, (8) is the rotation axis of the crankshaft, (9) is the slider means for the thrust loads and (10) is a balancing web of the crankshaft. FIGS. 13 to 20 show the 'opposed piston' version and some applications.

Figure 1:
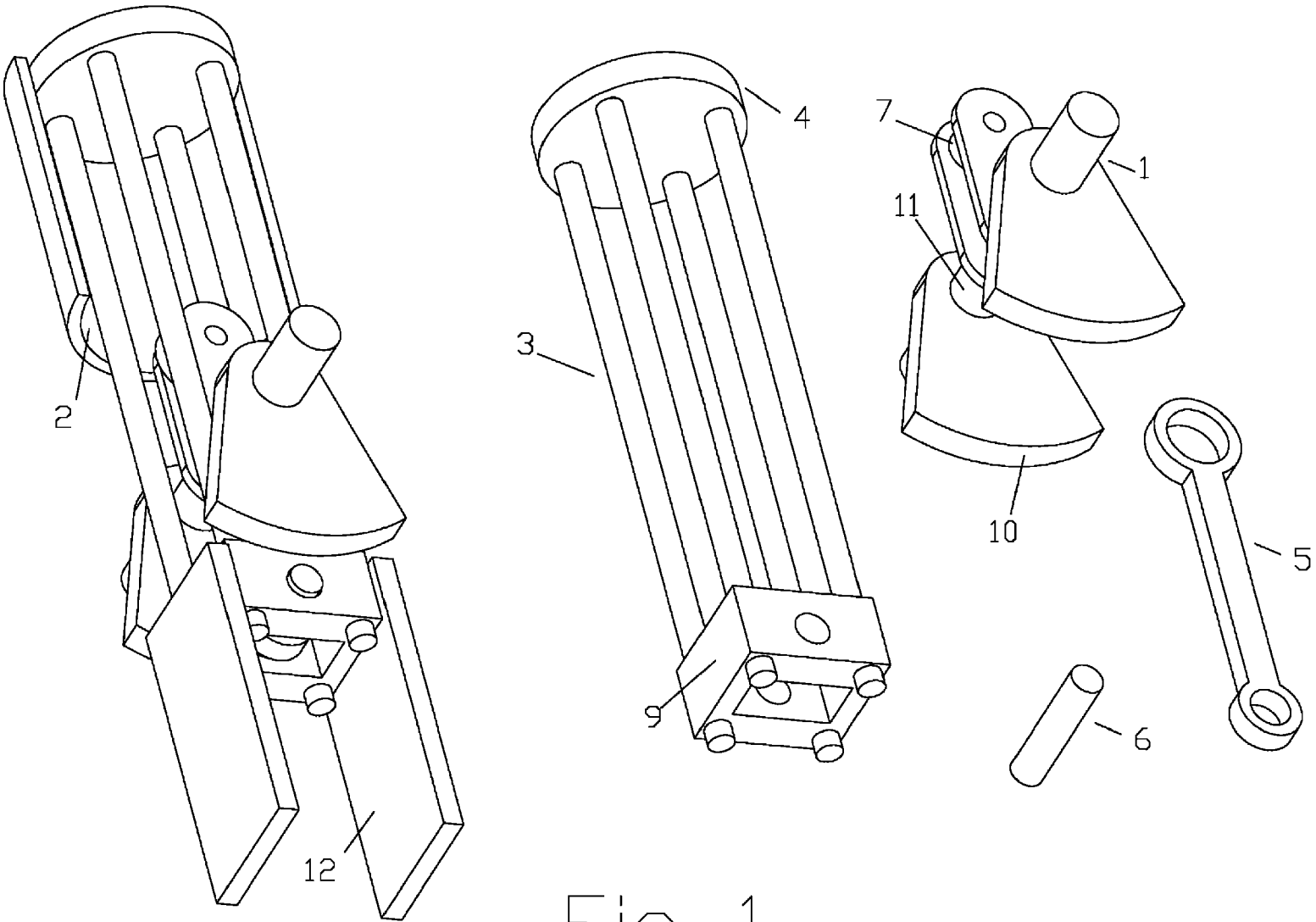
Figure 2:
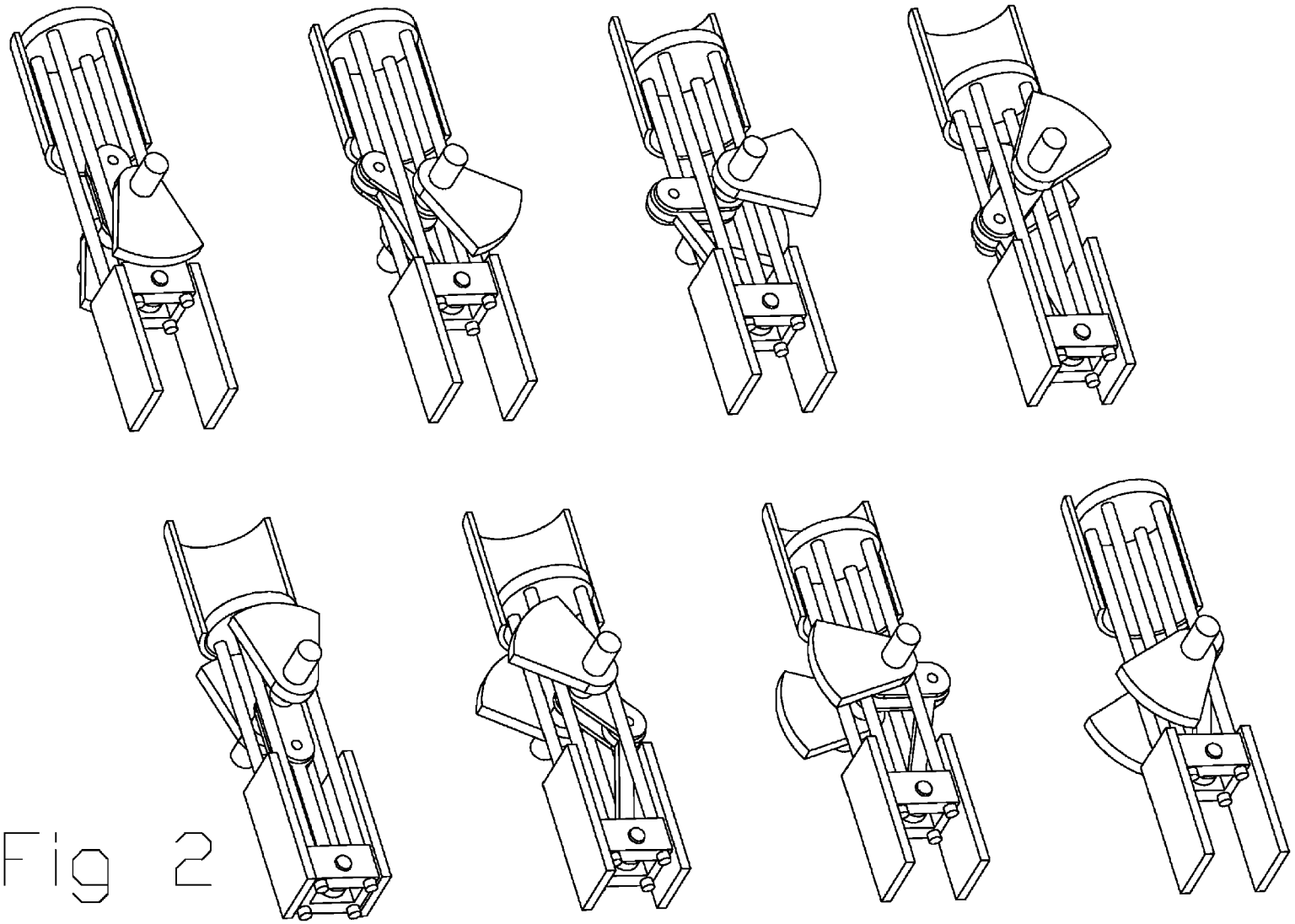
Figure 3:
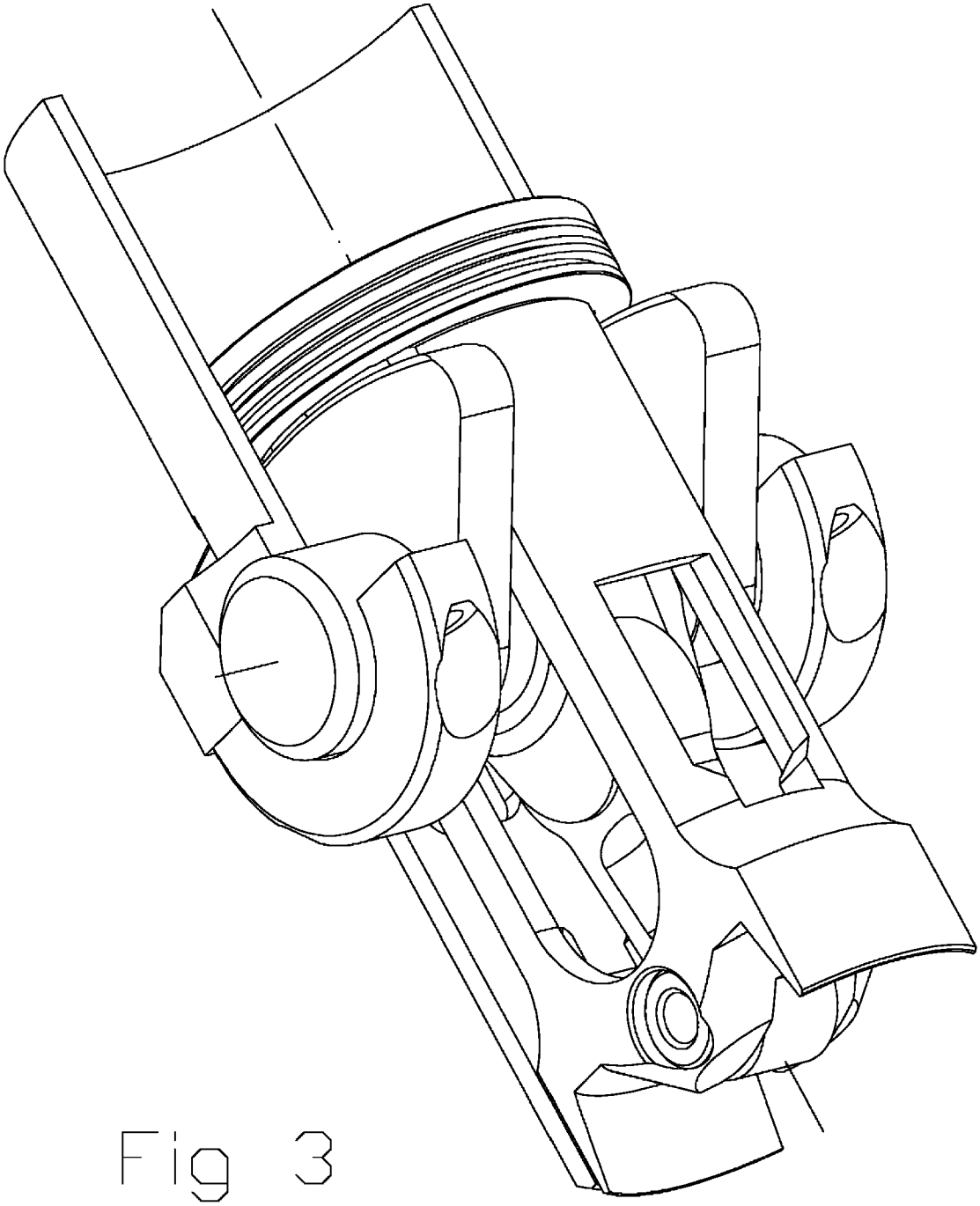
Figure 4:
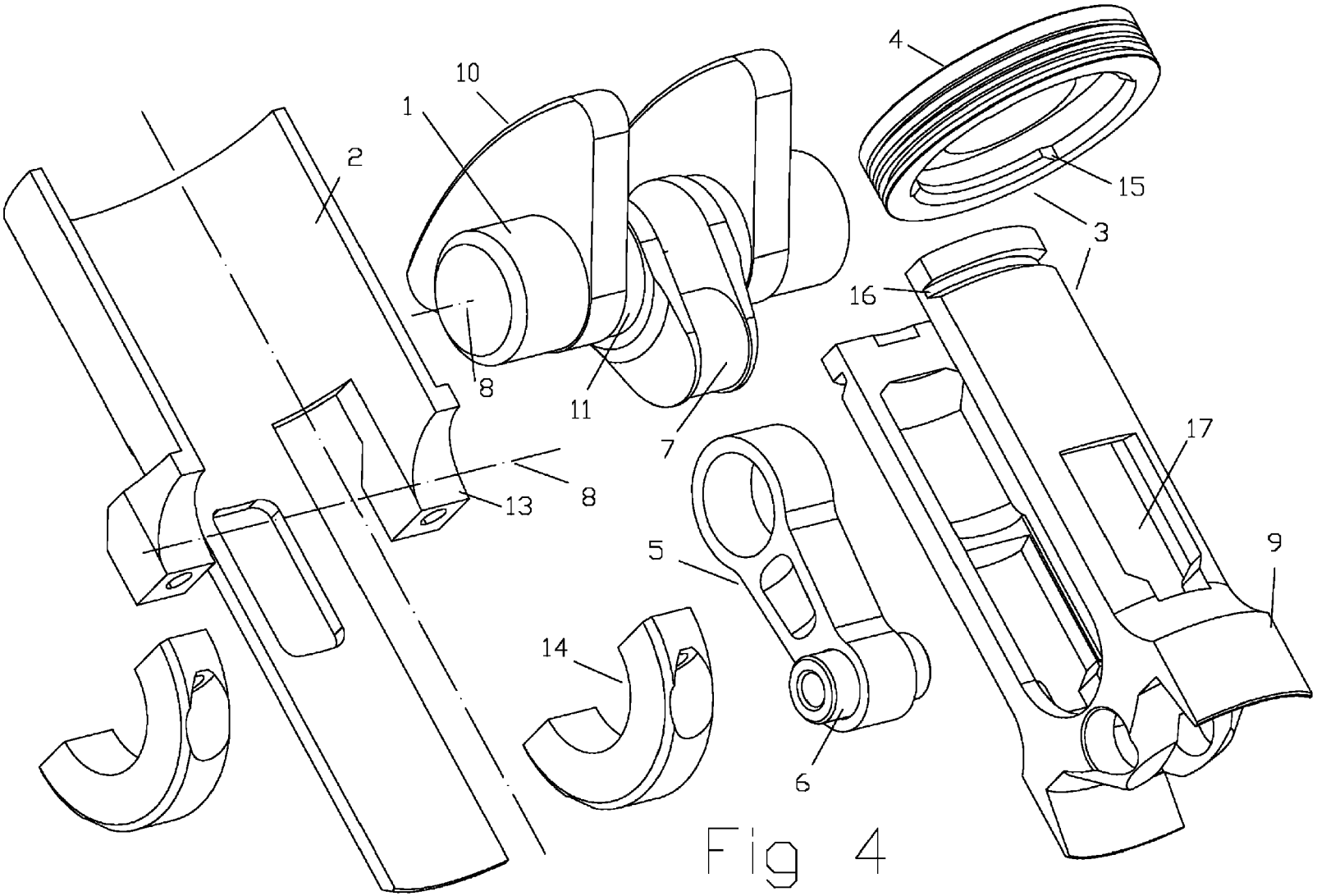
Figure 5:
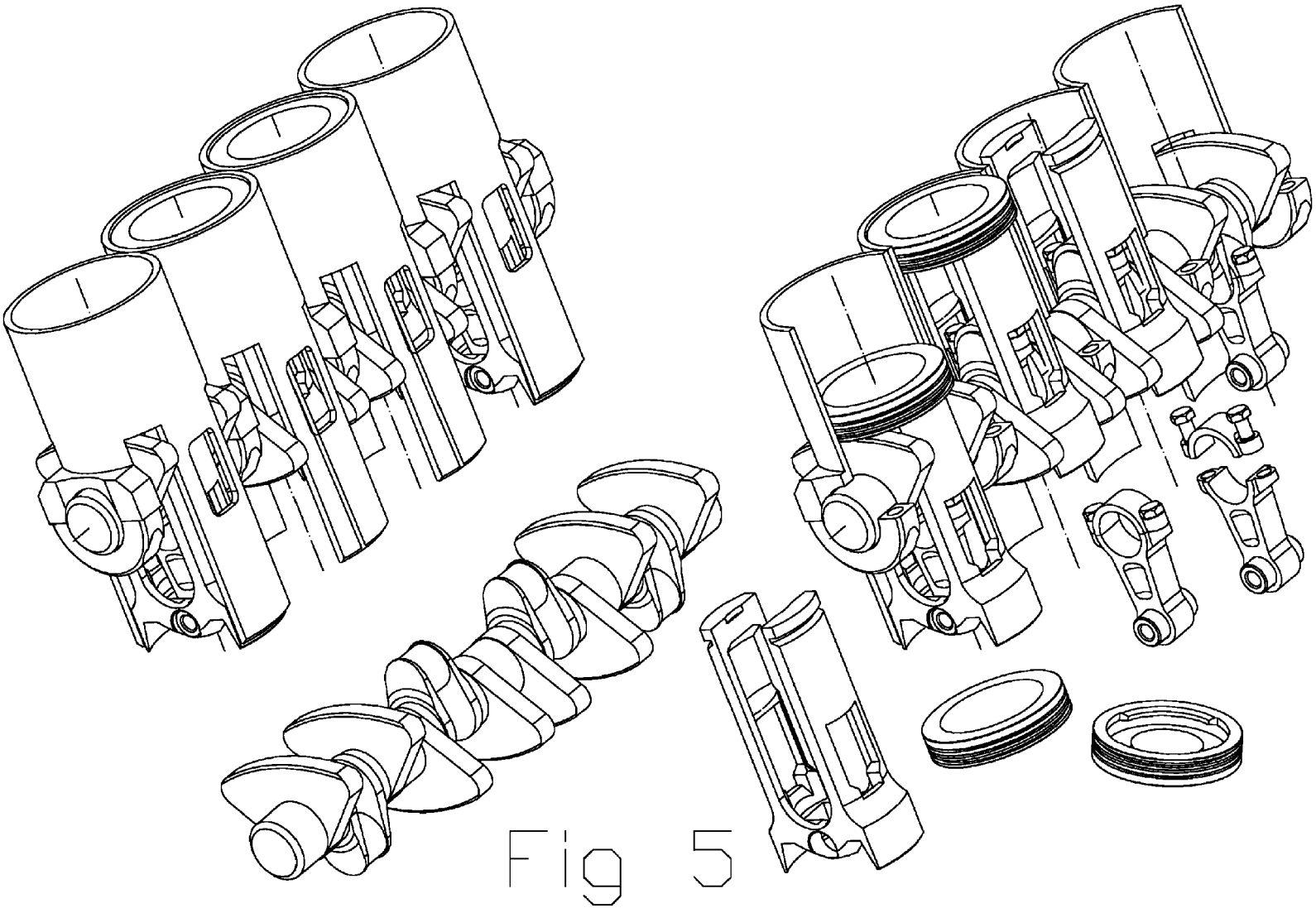

FIGS. 1 and 2 show the idea simplified.

FIG. 3 to 6 show the application of the idea in a single and a four cylinder engine. The piston is made of two parts, for assembling reasons, locked to each other at (15) and (16). The piston body has slots (17) to allow the motion of the connecting rod. The piston has, at piston pin side, slider means (9) similar to the conventional piston skirt. The narrowing (11) of the crankshaft, between the crankpin (7) and the balancing web (10), allows reasonable dimensions, inertia and strength for the piston.

Figure 7:
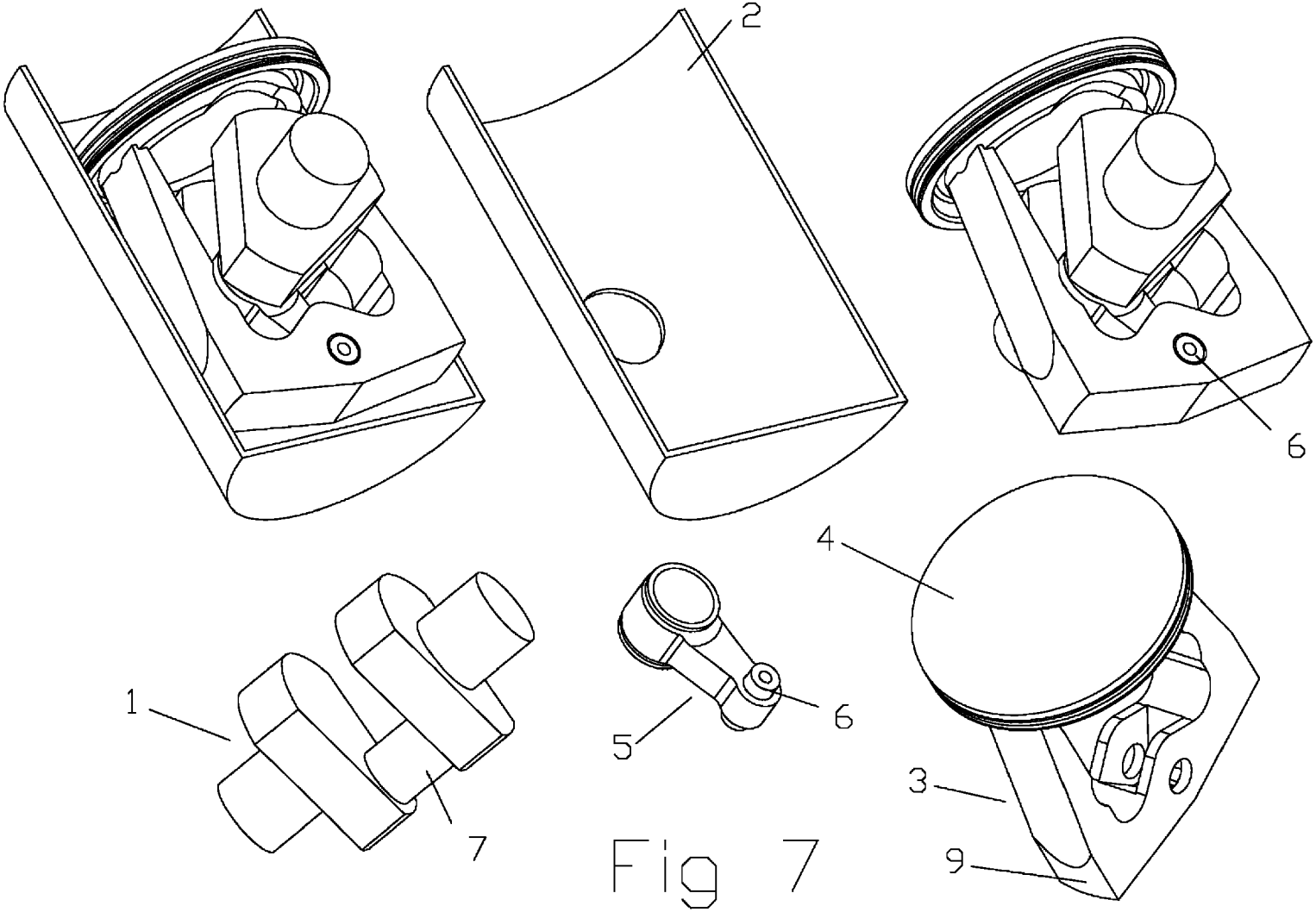
Figure 8:
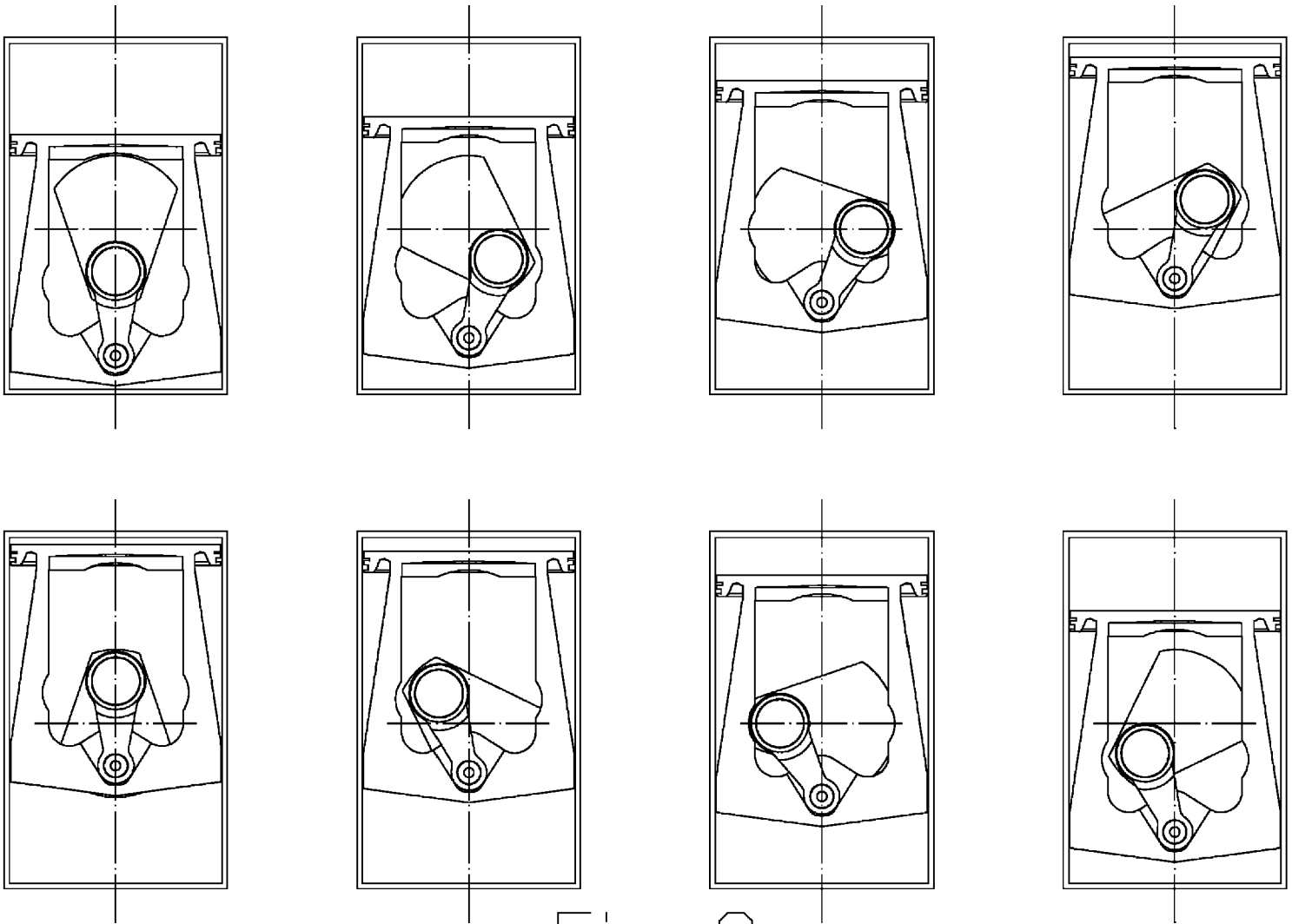
Figure 11:
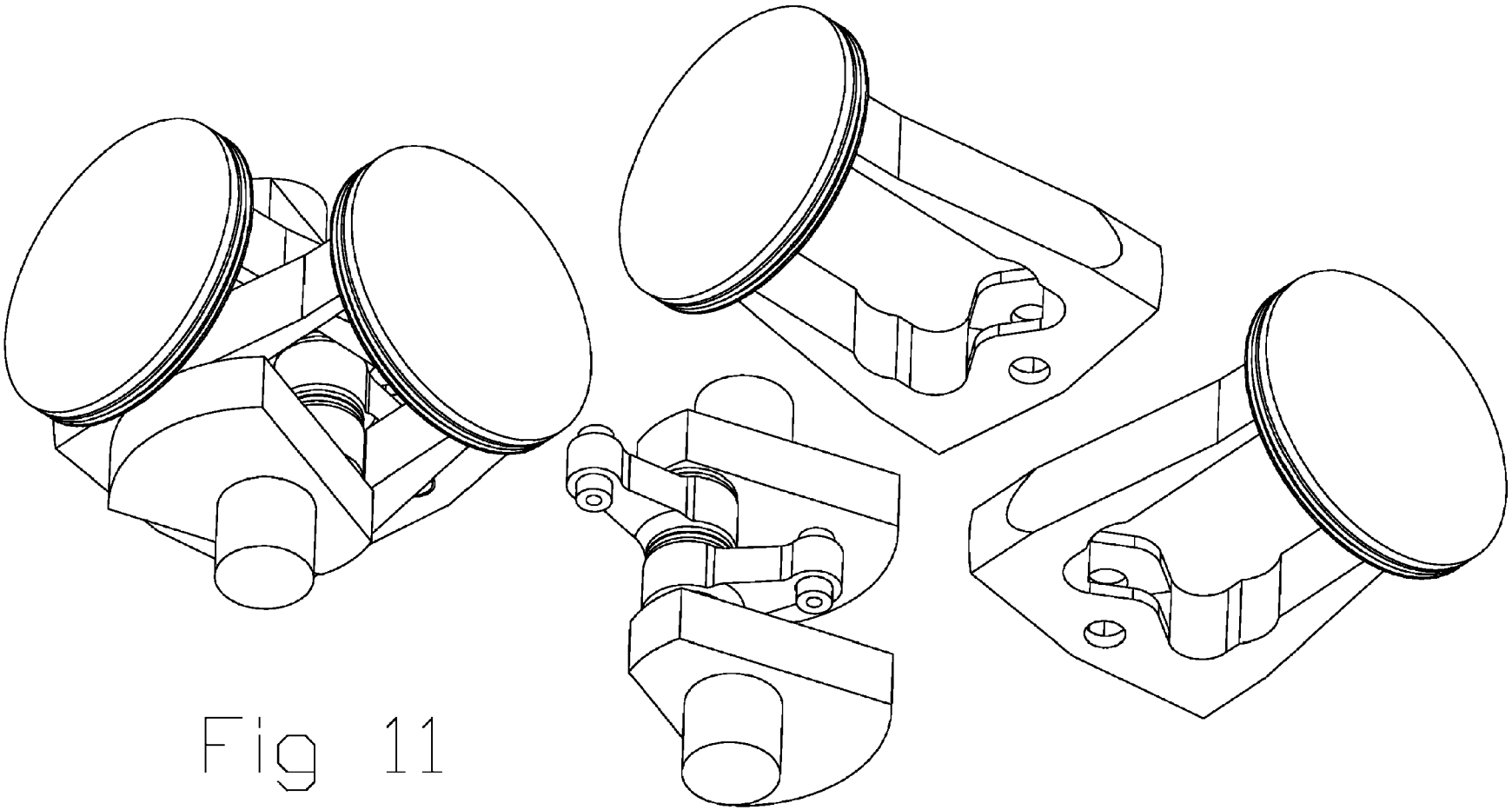
Figure 12:
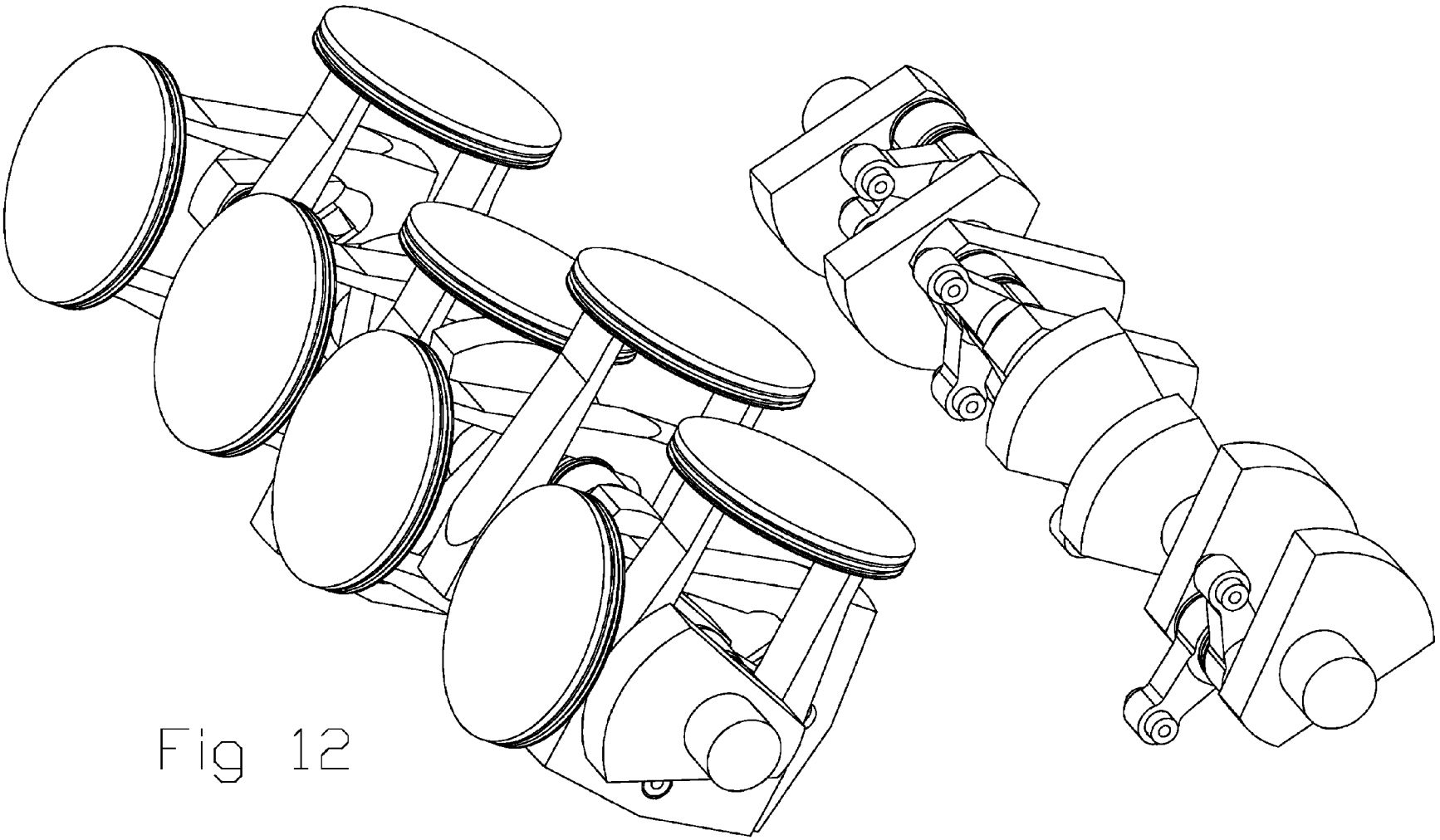
Figure 13:
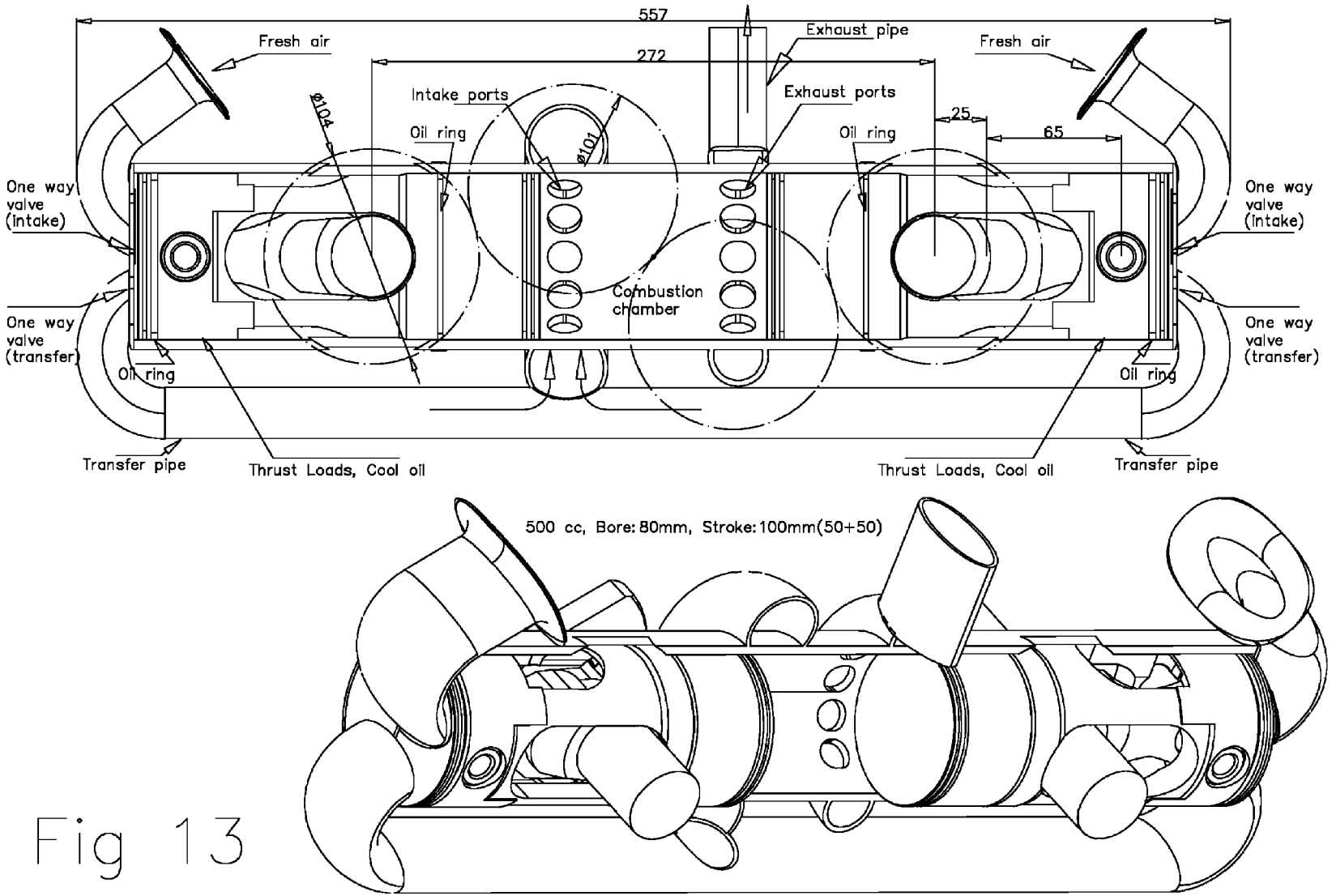
Figure 14:
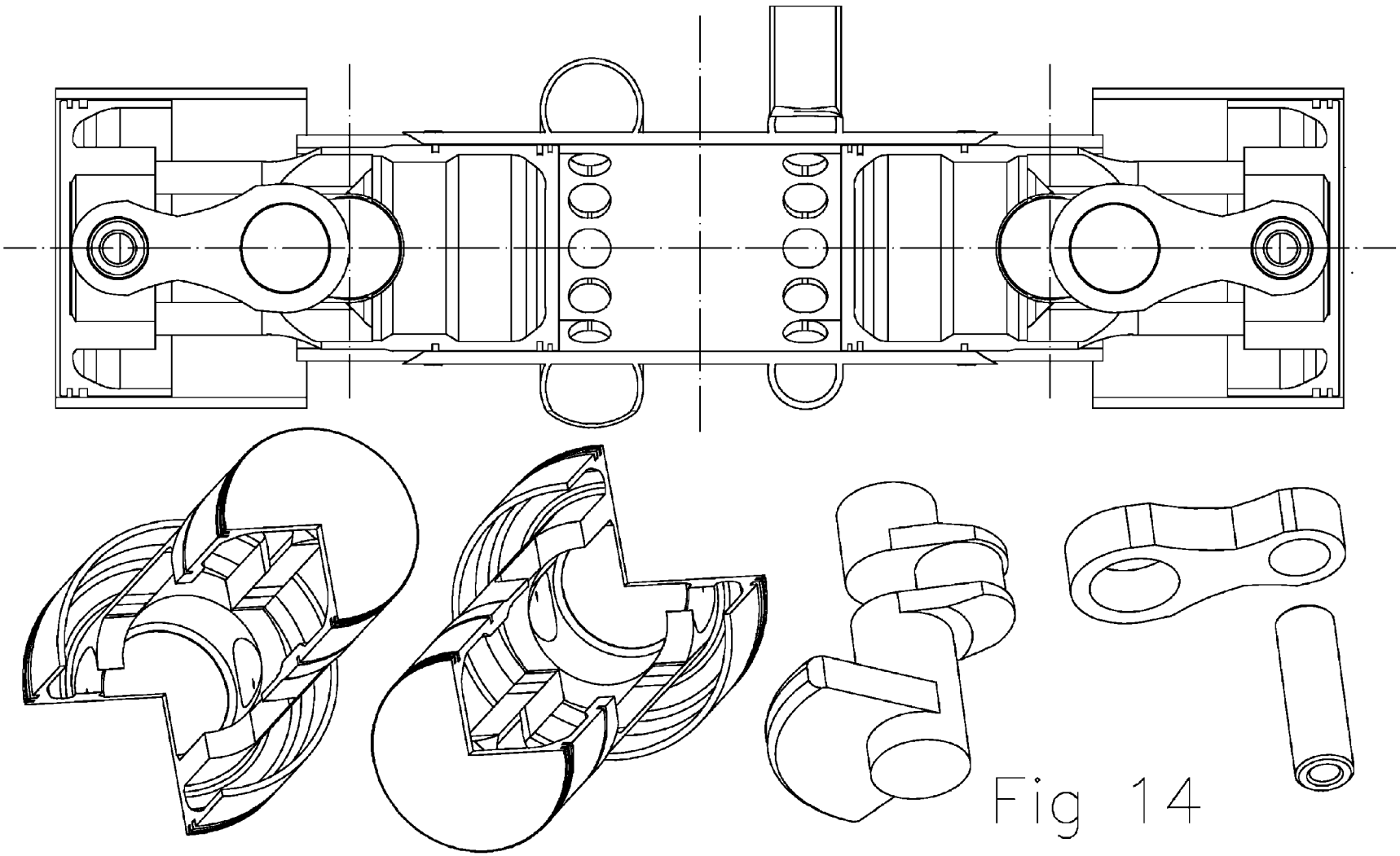

FIGS. 7 and 8 show another realization, applicable in short stroke engines, like racing. FIG. 11 shows a two cylinder V90 based on the same parts, while FIG. 12 shows the moving parts of an eight cylinder V90 engine.

Figure 9:
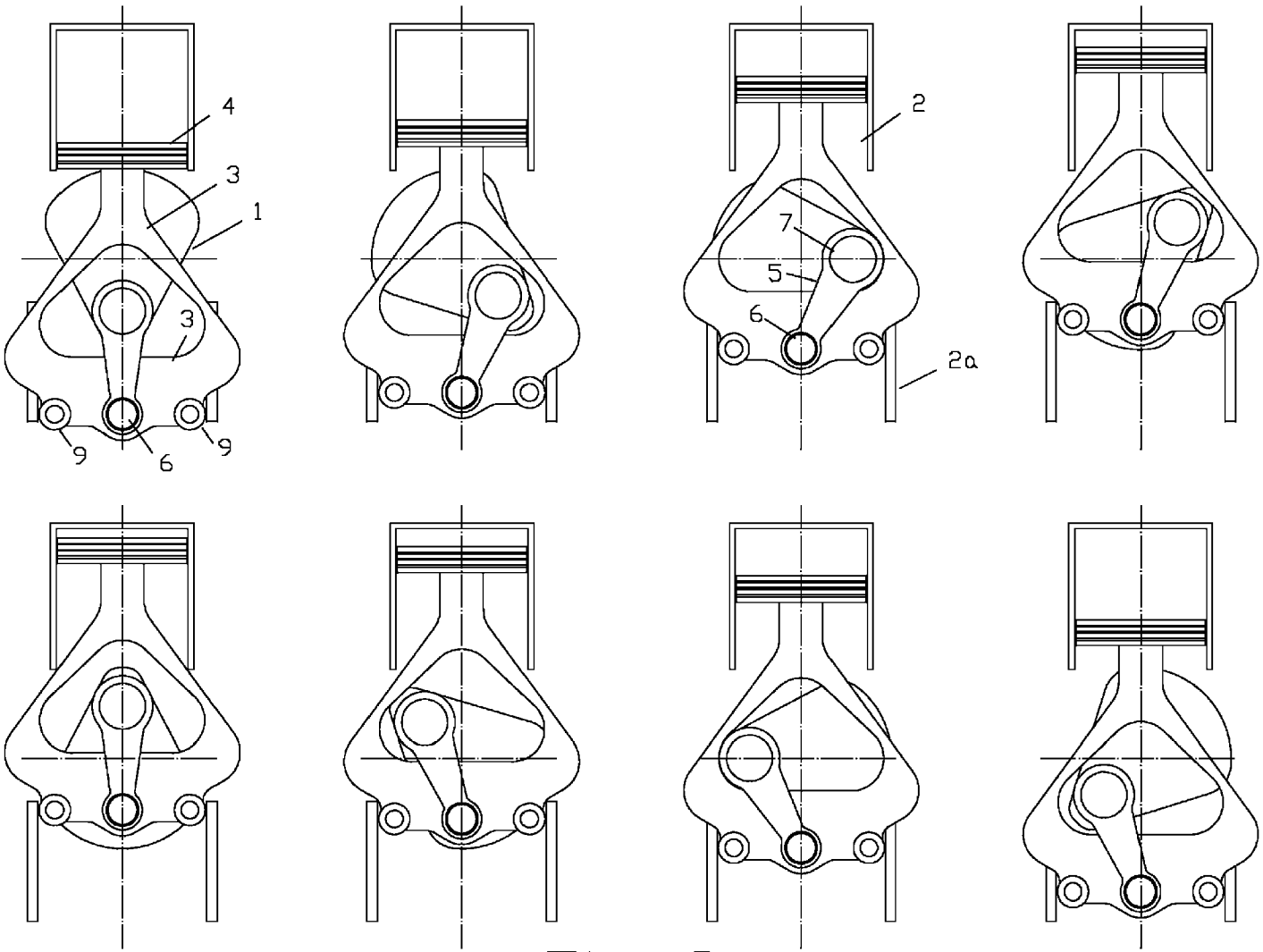

For longer stroke the piston of FIG. 7 can be modified to that shown in FIG. 9, where the triangular shape provides rigidity and lightweight. In FIG. 9 the thrust loads are carried by rollers (9).

The significance of the connecting rod length, in terms of the additional time the piston dwells close to Top Dead Center, becomes clear by the table in FIG. 10. Using short connecting rod and operating the pulling rod engine at around 5500 rpm the working medium feels, in terms of time—volume conditions, like being burned inside a long rod conventional engine revving at 4000 rpm (5600=1.4*4000). On this basis the power concentration, especially of Diesel and natural gas engines, can significantly rise.

Although the piston is longer, the engine can be shorter and the distance between cylinder head and crankshaft can be significantly smaller compared to the conventional of same stroke.

Lower compression ratio can be used to reduce parts' stress, especially for Diesels, without reducing the efficiency, because what counts is not the nominal compression ratio but the average compression ratio during combustion.

Racing engines' robustness, compactness and power output can be improved.

A shorter connecting rod is lighter, more rigid, proper for higher revs and provides more time for the combustion. The gas pressure on the piston crown and the maximum inertia force load the connecting rod only in tension.

The thrust loads are transferred to the casing not at the hot cylinder wall near combustion chamber, but at the other end of the piston, with either traditional slider means or rolling means etc. The clearance and the lubrication in this area of the piston is easier to control and more reliable, providing more suppression of the impact loads from combustion and inertia forces. In case of using short or very short connecting rod, the additional thrust loads are small price, in terms of mechanical friction and vibration, compared to the gains from the improved combustion.

The 'opposed piston' PRE of FIGS. 13 to 20 achieves autarkic and efficient operation with less weight and bulk. The thermal efficiency is increased by increasing the degree of constant volume of the working medium at the time of combustion. The additional time at high compression can shift the efficient combustion rev limit higher, especially for the compression ignition engines, thereby increase the power concentration. The pistons have crowns on both ends. The distal, from engine's center, crowns, in cooperation with one way valves, create the scavenging pumps or the compressors at the edges of the engine, while the other crowns form the combustion chamber at the center, achieving through scavenging. The two short stroke opposite pistons generate a long central cylinder and consequently a compact and efficient combustion chamber. Each crankshaft is disposed between its mate wrist pin and the combustion chamber. Obviously, the wrist pins can be located at the other side of the pistons, i.e. at the side of the combustion crown, but this shortens the time available for an efficient combustion.

Figure 15:
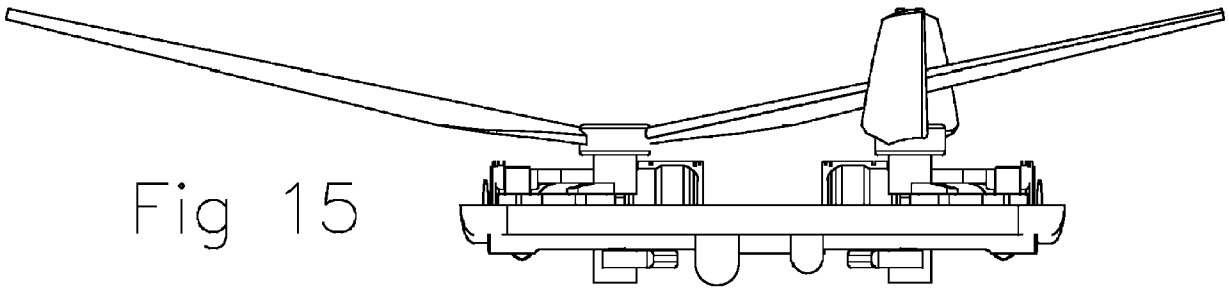
Figure 16:
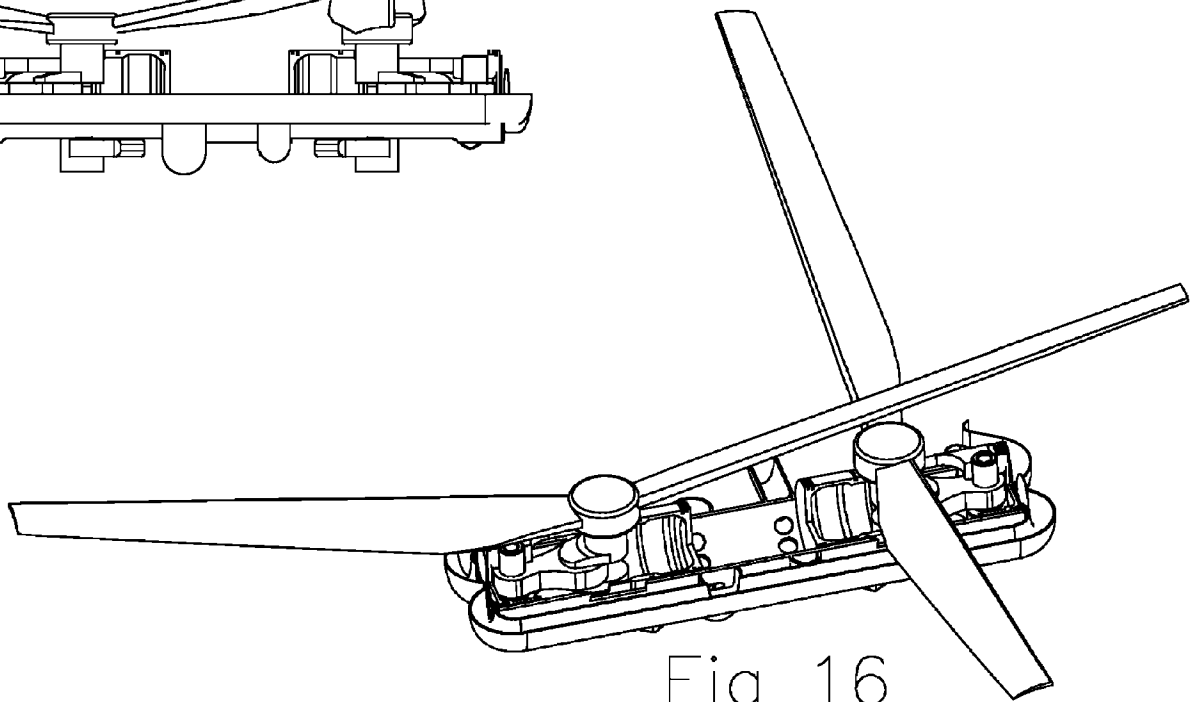

In FIGS. 15 and 16 each one of the two opposite rotating, in synchronization, crankshafts drives a rotor/helix with inclined blades to form a portable flying machine. Rotors with inclined blades are still unconventional.

Figure 17:
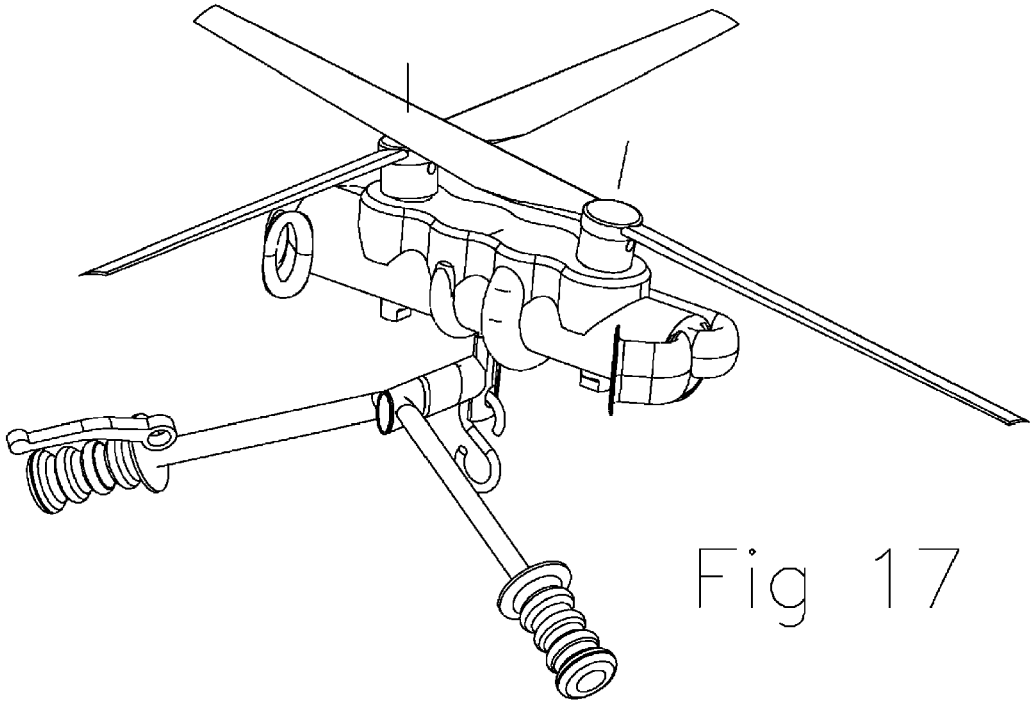
Figure 18:
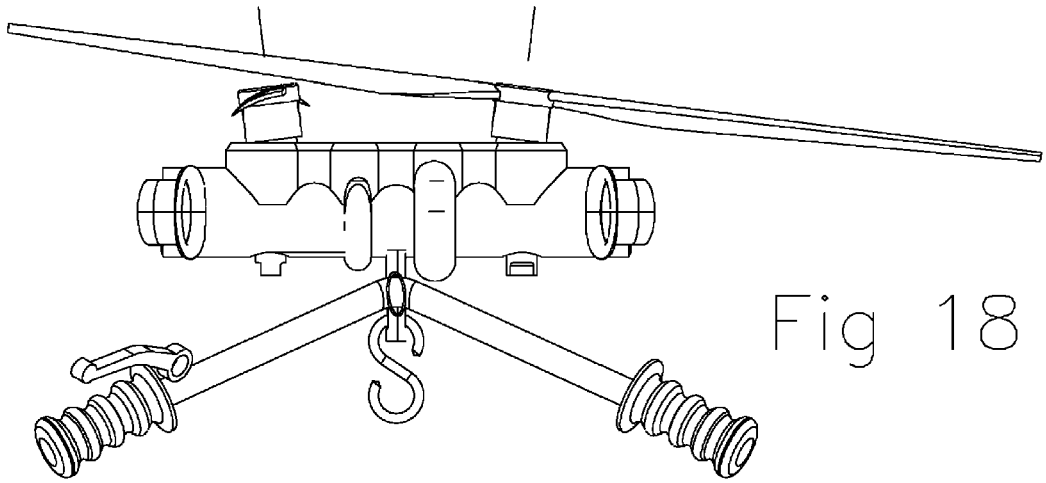

In FIGS. 17 and 18 the opposed piston PRE drives two conventional rotors. Each rotor is connected to its mate crankshaft by means of a constant speed, or Cardan, connection and is rotatably mounted on the casing of the engine at a small inclination compared to its mate crankshaft axis. This way the two, parallel and close to each other, crankshafts drive two 'inclined' large diameter conventional rotors without collision. This arrangement seems ideal for portable flying machines.

In the flying machines of FIGS. 15 to 18, the flyer/pilot keeps control by changing the revs/load of the engine and by displacing his body with respect to the engine/rotors set. The motion can be from pure hovering to airplane like flight. There is no torque from the rotors to compensate, there are neither inertia nor combustion vibrations and the noise is suppressed because the blades only gradually sweep one over the other. Animations can be found at www.pattakon.com web site.

The crux of a portable flyer has always been the weight of the prime mover, the resulting reaction torque, the vibrations and the consumption. To allow for flights at higher altitudes, or to just supercharge the opposed piston PRE, the diameter of the compressor crown can increase, as in FIG. 14, to compensate for the drop of the air density. The absence of camshafts, of timing belts, of poppet valves etc makes the engine reliable and light. With the two rotors having similar resistance in rotation, the four synchronizing gears, shown by the dashed dot circles in FIG. 13, remain almost unloaded.

The systems shown in FIGS. 15 to 18 can also be used as the propulsion system of airplanes and helicopters, releasing the body of the aircraft from vibrations and reaction torque. It is obvious that the piston crowns need not be of the same size, that one piston can be conventional or just a sleeve valve and that the through scavenging is just an option.

Figure 19:
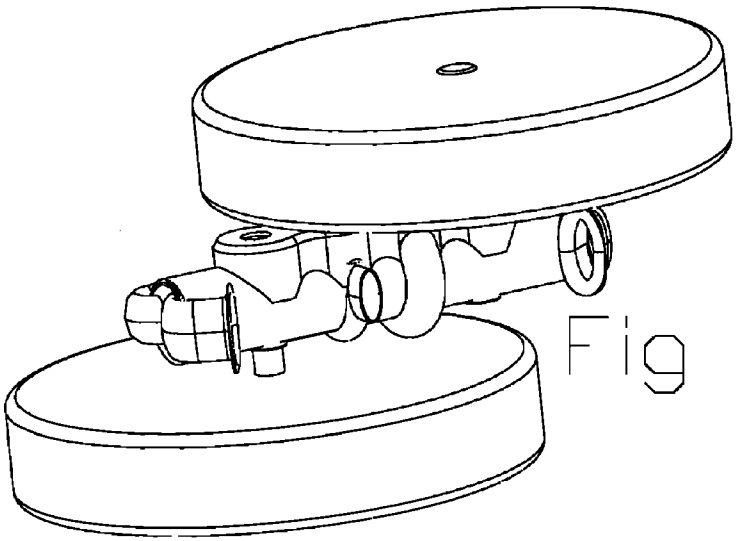

Replacing the two rotors of FIGS. 15 to 18 by two electric generators, an inertia vibration free and combustion vibration free electric power plant can result, as shown in FIG. 19, for hybrid cars, vibration sensitive applications, stationary applications etc.

Figure 20:
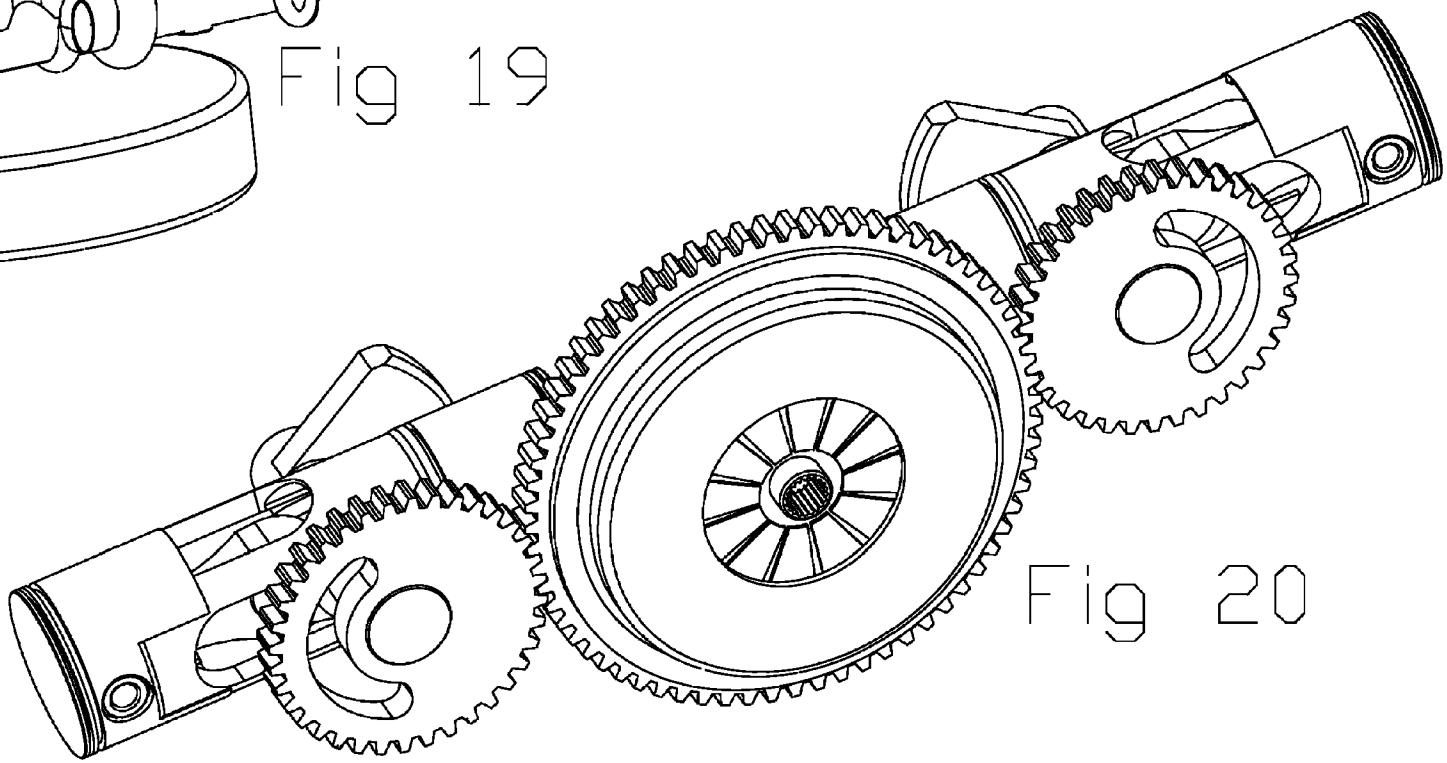

FIG. 20 shows another opposed piston PRE arrangement applicable on bikes, cars, trucks etc. The two crankshafts rotate in synchronization at the same direction by means of the central spur gear. The power flows from the two crankshaft to the central spur gear and then, through the clutch, to the gearbox or load.

Although the invention has been described and illustrated in detail, it is to be clearly understood that the same is by way of illustration and example, and is not to be taken by way of limitation. The spirit and scope of the present invention are to be limited only by the terms of the appended claims.

The invention claimed is:

1. A reciprocating internal combustion engine comprising:

a cylinder;

a crankshaft;

a piston slidably fitted in said cylinder, said piston sealing one side a combustion chamber defined by said piston and cylinder, said piston having a first end adjacent said combustion chamber and a second opposite end having a wrist pin, said piston having an opening between said ends;

a crankshaft extending through said opening and connected to said wrist pin by a connecting rod.

2. A reciprocating internal combustion engine according the claim 1, characterized in that combustion occurs exclusively at the side of the first end of the piston.

3. A reciprocating internal combustion engine according the claim 1, characterized in that the thrust loads are taken either by conventional slider means or by rollers reciprocating together with the piston.

4. A reciprocating internal combustion engine according the claim 1, characterized in that a second crankshaft rotates in synchronization with said crankshaft, a second piston is attached to said second crankshaft by a second connecting rod, said piston and said second piston seal the two sides of said combustion chamber to form an opposed piston engine.

5. A reciprocating internal combustion engine according the claim 1, characterized in that a second crankshaft rotates in synchronization with said crankshaft, a second piston is attached to said second crankshaft by a second connecting rod, said piston and said second piston seal the two sides of said combustion chamber to form an opposed piston engine, said piston and said second piston have secondary piston crowns forming scavenging pumps for the engine.

6. A reciprocating internal combustion engine according the claim 1, characterized in that the crankshaft serves more than one cylinders.

7. A reciprocating internal combustion engine according the claim 1, characterized in that it comprises:

a second crankshaft, said second crankshaft rotates in synchronization with said crankshaft;

a second piston slidably fitted in said cylinder, said second piston sealing one side of said combustion chamber defined by said piston, said second piston and said cylinder, said second piston having a first end adjacent said combustion chamber and a second opposite end having a wrist pin, said second piston having an opening between said ends;

the second crankshaft extending through said opening of said second piston and connected to the wrist pin of said second piston by a second connecting rod.

8. A reciprocating internal combustion engine according the claim 1, characterized in that it comprises:

a second crankshaft, said second crankshaft rotates in synchronization with said crankshaft;

a second piston slidably fitted in said cylinder, said second piston sealing one side of said combustion chamber defined by said piston, said second piston and said cylinder, said second piston having a first end adjacent said combustion chamber and a second opposite end having a wrist pin, said second piston having an opening between said ends;

the second crankshaft extending through said opening of said second piston and connected to the wrist pin of said second piston by a second connecting rod, the opposite to the combustion chamber side of at least one of said piston and said second piston seals one side of a compression chamber of a pump or compressor or scavenging pump.

* * * * *